US011705101B1

(12) United States Patent
Morishima et al.

(10) Patent No.: US 11,705,101 B1
(45) Date of Patent: Jul. 18, 2023

(54) IRRELEVANT VOICE CANCELLATION

(71) Applicant: International Business Machines Corporation, Armonk, NY (US)

(72) Inventors: Akinobu Morishima, Tokyo (JP); Akio Oka, Kawasaki (JP); Sho Ayuba, Tokyo (JP); Eri Kimura, Setagaya (JP); Yukiko Furusho, Tachikawa (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 17/656,670

(22) Filed: Mar. 28, 2022

(51) Int. Cl.
*G10K 11/178* (2006.01)
*G10L 25/78* (2013.01)

(52) U.S. Cl.
CPC .. *G10K 11/17823* (2018.01); *G10K 11/17873* (2018.01); *G10L 25/78* (2013.01); *G10K 2210/3027* (2013.01); *G10K 2210/3044* (2013.01)

(58) Field of Classification Search
None
See application file for complete search history.

(56) References Cited

U.S. PATENT DOCUMENTS

| | | | | |
|---|---|---|---|---|
| 10,957,337 | B2 | 3/2021 | Chen | |
| 11,158,336 | B2 | 10/2021 | Hardek | |
| 2007/0110254 | A1 | 5/2007 | Christoph | |
| 2008/0084981 | A1 | 4/2008 | Lee | |
| 2021/0151066 | A1* | 5/2021 | McNeill | H04R 1/1008 |

(Continued)

FOREIGN PATENT DOCUMENTS

| | | | |
|---|---|---|---|
| CN | 102461140 | A | 5/2012 |
| CN | 106937194 | A | 7/2017 |
| CN | 109218912 | A | 1/2019 |

(Continued)

OTHER PUBLICATIONS

"A Method to Extract a Dedicated User's Voice Enhanced by the Dynamic Division of Frequency Bands Based on Physical Attributes", An IP.com Prior Art Database Technical Disclosure, Disclosed Anonymously, IP.com No. IPCOM000267896D, IP.com Electronic Publication Date: Dec. 2, 2021, 5 pages.

(Continued)

*Primary Examiner* — Kenny H Truong
(74) *Attorney, Agent, or Firm* — Stephen R. Yoder

(57) ABSTRACT

Computer-implemented methods, computer program products, and computer systems configured for receiving first audio data from a first computing device via a first microphone, receiving second audio data from a second computing device via a second microphone, detecting a first user utterance having a first user utterance local decibel measure in the first audio data and a first user utterance remote decibel measure in the second audio data, detecting a second user utterance having a second user utterance local decibel measure in the second audio data and a second user utterance remote decibel measure in the first audio data, determining a first cancelling coefficient based on the second user utterance detected at the first microphone and the second user utterance detected at the second microphone, applying the first cancelling coefficient to the first audio data, and generating first output audio data comprising the first user utterance at the first computing device.

20 Claims, 7 Drawing Sheets

(56) References Cited

U.S. PATENT DOCUMENTS

2021/0241744 A1 8/2021 Gupta

FOREIGN PATENT DOCUMENTS

| | | | |
|---|---|---|---|
| CN | 111445901 | A | 7/2020 |
| CN | 112071328 | A | 12/2020 |
| JP | 2020177174 | A | 10/2020 |

OTHER PUBLICATIONS

"Face-api", GitHub, Printed Jan. 6, 2022, 24 pages, <https://github.com/justadudewhohacks/face-api.js/>.

"SpeechRecognition", MDN Web Docs, Printed Jan. 6, 2022, 24 pages, <https://developer.mozilla.org/en-US/docs/Web/API/SpeechRecognition>.

"Patent Cooperation Treaty PCT Notification of Transmittal of the International Search Report and the Written Opinion of the International Searching Authority, or the Declaration", Applicant's file reference EIE220865PCT, International application No. PCT/CN2023/070485, International filing date Jan. 4, 2023, dated Mar. 15, 2023, 9 pages.

* cited by examiner

IRRELEVANT VOICE CANCELLATION

BACKGROUND

The present invention relates generally to the field of audio signal processing, and more particularly to processing audio signals for irrelevant voice cancellation based multiple microphone inputs.

Background noise cancellation has been an emerging technology ever since the advent of audio signal transmission via personal computing devices and in the transportation industry where airplanes and locomotives improve the traveling experience by cancelling out jet engine/propeller or engine noise. Capturing the audio wave signals and inverting them to cancel out the ambient noise resulted in the user only hearing the sounds they desire. Such active noise control measures are employed for reducing unwanted sound by the addition of a second sound specifically designed to cancel the first.

SUMMARY

Embodiments of the present invention disclose a computer-implemented method, a computer program product, and a computer system for irrelevant voice cancellation. The computer-implemented method for irrelevant voice cancellation may include one or more processors configured for receiving first audio data from a first computing device via a first microphone and receiving second audio data from a second computing device via a second microphone. Further, the computer-implemented method may include one or more processors configured for detecting a first user utterance having a first user utterance local decibel measure in the first audio data and the first user utterance having a first user utterance remote decibel measure in the second audio data and detecting a second user utterance having a second user utterance local decibel measure in the second audio data and the second user utterance having a second user utterance remote decibel measure in the first audio data. Furthermore, the computer-implemented method may include one or more processors configured for determining a first cancelling coefficient based on the second user utterance detected at the first microphone and the second user utterance detected at the second microphone. Even further, the computer-implemented method may include one or more processors configured for applying the first cancelling coefficient to the first audio data and generating first output audio data comprising the first user utterance at the first computing device.

DETAILED DESCRIPTION

Figure 1:
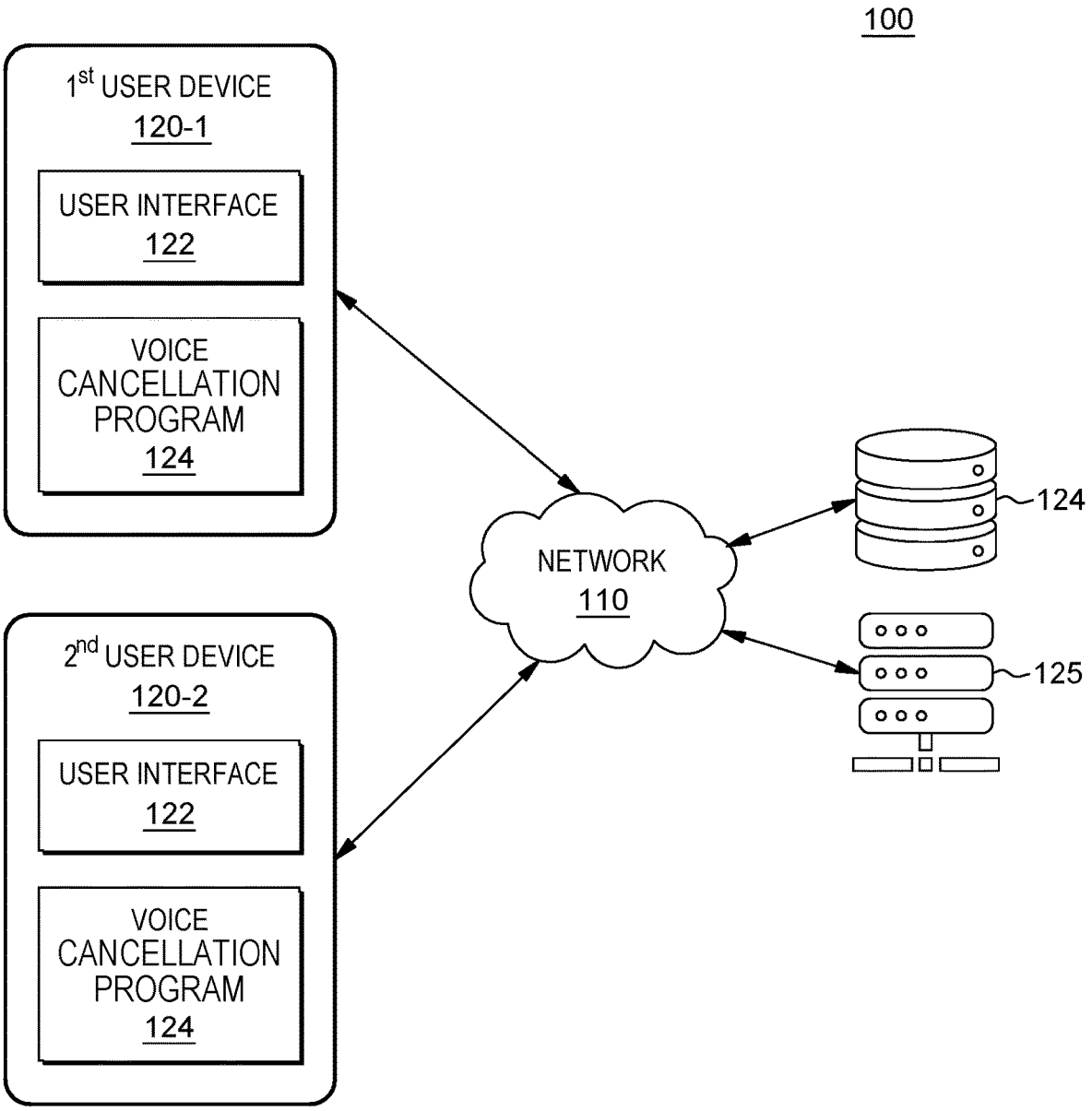
FIG. 1 is a functional block diagram illustrating a distributed data processing environment for irrelevant voice cancellation, in accordance with an embodiment of the present invention.

Embodiments of the present invention recognize that when there are more than one user participating in different web conferences in an open space or within the same room (e.g., two persons working from home in the same room), a microphone used by a first user acquires audio signals from conversations from a second user and/or the second user computing device in the vicinity of the first user microphone. Each user is engaged in a different communication and speaks at independent timing so that a microphone mute function does not solve the problem. Further, even if a headset is used, for example, speech voices in the same room are mixed and detected as audio input to an attached microphone, leading to audio signal interference. Due to the first user computing device microphone and the second user conversations being within proximity, audio signals originating from the second user interfere with the first user web conference experience.

Embodiments of the present invention recognize that, although there are methods to cancel voice signals other than that of a speaker by applying noise cancellation, the methods require several microphones for one user speaking or a microphone exclusively used for acquiring noise. Rather, embodiments of the present invention are directed to computer-implemented methods to cancel speech voices other than a user's own speech voice by utilizing mutual microphone inputs by users within proximity of each other, or within the same room.

Embodiments of the present invention describe computer-implemented methods, computer program products and computer systems configured for cancelling interfering audio signals, which are generated from within the vicinity of a second computing device, from audio signals generated proximate to a first computing device, wherein output audio signals from the first computing device may only include audio signals generated by the first user at the first computing device.

In an example embodiment of the present invention, the computer-implemented method may include one or more processors configured for detecting a first user utterance (e.g., $A_{AM}$) at a first microphone (e.g., $A_M$) of a first computing device and a second user utterance (e.g., $B_{BM}$) at a second microphone (e.g., $B_M$) of a second computing device, wherein the first user utterance and the second user utterance are detected by respective microphones of respective computing devices within acoustic proximity of each other. For example, first audio data (e.g., A) may be received from a first computing device via a first microphone of and second audio data (e.g., B) may be received from a second computing device via a second microphone. Further, the first audio data (e.g., A) may include a sum of the first user utterance (e.g., $A_{AM}$) and a second user utterance (e.g., $B_{AM}$) detected at the first microphone of the first computing device, wherein the first user utterance (e.g., $A_{AM}$) may include a local decibel measure (e.g., $ldBA_{AM}$) in the first audio data (e.g., A) that is greater than a remote decibel measure (e.g., $rdBA_{BM}$) in the second audio data (e.g., B). In other words, the local decibel measure (e.g., $ldBA_{AM}$) of the first user utterance (e.g., $A_{AM}$) in the first audio data may be greater than a remote decibel measure (e.g., $rdBA_{AM}$) of the first user utterance (e.g., $A_{BM}$) detected in the second audio data (e.g., B) because of the distance between the first microphone of the first computing device and the second microphone of the second computing device since the first user is closer to the first microphone relative to the second microphone.

Further, for example, second audio data (e.g., B) may include a sum of the first user utterance (e.g., $A_{BM}$) detected at the second microphone (e.g., $B_M$) of the second computing device and the second user utterance (e.g., $B_{BM}$) detected at the second microphone (e.g., $B_M$) of the second computing device, wherein the second user utterance (e.g., $B_{BM}$) may include a local decibel measure (e.g., $ldBB_{BM}$) in the second audio data (e.g., B) that is greater than a remote decibel measure (e.g., $rdBB_{AM}$) in the first audio data (e.g., A). In other words, the local decibel measure (e.g., $ldBB_{BM}$) of the second user utterance in the second audio data (e.g., B) may be greater than a remote decibel measure (e.g., $rdBB_{AM}$) of the second user utterance in detected the first audio data (e.g., A) because of the distance between the second microphone (e.g., $B_M$) of the second computing device and the first microphone (e.g., $A_M$) of the first computing device since the second user is closer to the second microphone relative to the first microphone.

In an example embodiment of the present invention, the computer-implemented method may include one or more processors configured for cancelling the second user utterance (e.g., $B_{AM}$) detected at the first microphone in the first audio data (e.g., A). For example, to cancel the second user utterance (e.g., $B_{AM}$) in the first audio data (e.g., A), the one or more processors may be configured for determining a first cancelling coefficient (e.g., $\mu B_A$) based on the second user utterance (e.g., $B_{AM}$) detected at the first microphone and the second user utterance (e.g., $B_{BM}$) detected at the second microphone. In other words, a value (e.g., $A_0=(A_{AM}+B_{AM})-\mu_{BA}(A_{BM}+B_{BM})$) obtained by constant multiplication of the first user utterance (e.g., $A_{BM}$) and the second user utterance (e.g., $B_{BM}$) detected at the second microphone may be subtracted (or an inverted phase is added), wherein the first cancelling coefficient may be a constant value (e.g., $\mu_{BA}<1$) that is less than 1 and satisfies the equation (e.g., $B_{AM}=\mu_{BA}B_{BM}$) where the second user utterance (e.g., $B_{AM}$) detected at the first microphone is equal to the first cancelling coefficient (e.g., $\mu B_A$) times the second user utterance (e.g., $B_{BM}$) detected at the second microphone. In an embodiment, a second cancelling coefficient (e.g., $\mu A_B$) may correspond to a duration in which no audio data is received at the first microphone or may be obtained when the first user utterance (e.g., $A_{AM}$) detected at the first microphone is zero and equal to the first user utterance (e.g., $A_{BM}$) detected at the second microphone.

In an example embodiment of the present invention, the computer-implemented method may include one or more processors configured for applying the first cancelling coefficient to the first user utterance at the first computing device and generating first output audio data comprising the first user utterance at the first computing device. For example, first output audio data (e.g., $A_0=A_{AM}-\mu_{BA}A_{BM}$) may correspond to the first user utterance (e.g., $A_{AM}$) detected at the first computing device minus the first cancelling coefficient multiplied by the first user utterance (e.g., $A_{BM}$) detected at the second microphone of the second computing device. Accordingly, the first output audio data may be generated at the first computing device thus cancelling the second user utterance detected at the first computing device.

In an example embodiment of the present invention, the computer-implemented method may include one or more processors configured for generating second output audio data comprising the second user utterance at the second computing device by applying a second cancelling coefficient to the first user utterance detected at the second computing device and generating second output audio data comprising only the second user utterance at the second computing device, thereby cancelling the first user utterance detected at the second computing device similarly to how the second user utterance was cancelled at the first computing device, as described above herein.

Additional embodiments of the present invention describe computer-implemented methods, computer program products and computer systems configured for cancelling interfering audio signals, which are generated from within the vicinity of a first computing device and a third computing device, from audio signals generated proximate to a second computing device, wherein output audio signals from the second computing device may only include audio signals generated by the second user or within immediate proximity to the second user at the second computing device.

As described above herein, and in this additional example embodiment of the present invention, the computer-implemented method may include one or more processors configured for detecting a plurality of user utterances (e.g., a first user utterance (e.g., $A_{AM}$) at a first microphone (e.g., $A_M$) of a first computing device, a second user utterance (e.g., $B_{BM}$) at a second microphone (e.g., $B_M$) of a second computing device, and a third user utterance (e.g., $C_{CM}$) at a third microphone (e.g., $C_M$) of a third computing device), wherein the first user utterance, the second user utterance, and the third user utterance may be detected by respective microphones of respective computing devices within acoustic proximity of each user. For example, first audio data (e.g., A) may be received at a first microphone of a first computing device, second audio data (e.g., B) may be received at a second microphone of a second computing device, and third audio data (e.g., C) may be received at a third microphone of a third computing device. Further, the first audio data (e.g., A) may include a sum of the first user utterance (e.g., $A_{AM}$), a second user utterance (e.g., $B_{AM}$), and a third user utterance (e.g., $C_{AM}$) detected at the first microphone (e.g., $A_M$) of the first computing device, wherein the first user utterance (e.g., $A_{AM}$) may include a local decibel measure (e.g., $ldBA_{AM}$) in the first audio data (e.g., A) that is greater than a first remote decibel measure (e.g., $r1dBA_{BM}$) in the second audio data (e.g., B) and a second remote decibel measure (e.g., $r2dBA_{CM}$) in the third audio data (e.g., C). In other words, the local decibel measure (e.g., $ldBA_{AM}$) of the first user utterance (e.g., $A_{AM}$) in the first audio data may be greater than a first remote decibel measure (e.g., $r1dBA_{BM}$) of the first user utterance (e.g., $A_{BM}$) detected in the second audio data (e.g., B) because of the distance between the first microphone of the first computing device and the second microphone of the second computing device since the first user is closer to the first microphone relative to the second microphone. Further in other words, the local decibel measure (e.g., $ldBA_{AM}$) of the first user utterance (e.g., $A_{AM}$) in the first audio data may be greater than a second remote decibel measure (e.g., r2dB$A_{CM}$) of the first user utterance (e.g., $A_{CM}$) detected in the third audio data (e.g., C) because of the distance between the first microphone of the first computing device and the third microphone of the third computing device since the first user is closer to the first microphone relative to the third microphone.

Further, for example, second audio data (e.g., B) may include a sum of the first user utterance (e.g., $A_{BM}$) detected at the second microphone (e.g., $B_M$) of the second computing device, the second user utterance (e.g., $B_{BM}$) detected at the second microphone (e.g., $B_M$) of the second computing device, and the third user utterance (e.g., $C_{BM}$) detected at the second microphone (e.g., $B_M$) of the second computing device, wherein the second user utterance (e.g., $B_{BM}$) may include a local decibel measure (e.g., ldB$B_{BM}$) in the second audio data (e.g., B) that is greater than a remote decibel measure (e.g., rdB$B_{AM}$) in the first audio data (e.g., A). In other words, the local decibel measure (e.g., ldB$B_{BM}$) of the second user utterance in the second audio data (e.g., B) may be greater than a remote decibel measure (e.g., rdB$B_{AM}$) of the second user utterance in detected the first audio data (e.g., A) because of the distance between the second microphone (e.g., $B_M$) of the second computing device and the first microphone (e.g., $A_M$) of the first computing device since the second user is closer to the second microphone relative to the first microphone.

Further, the additional embodiments of the present invention may include one or more processors configured to determine cancelling (or attenuation) coefficients between each pair of the user utterances detected at respective microphones. For example, cancelling coefficients (e.g., $\mu_{BA}$, $\mu_{AB}$) may be determined between the first audio data (e.g., A) received at the first microphone (e.g., $A_M$) and the second audio data (e.g., B) received at the second microphone (e.g., $B_M$), wherein the first audio data (e.g., A) and the second audio data (e.g., B) correspond to the first user speaking (e.g., first user utterances) and the second user speaking (e.g., second user utterances) within proximity of the first microphone (e.g., $A_M$) and the second microphone (e.g., $B_M$), respectively. Furthermore, the first audio data (e.g., A) may include the second user utterances as interfering audio signals to the first microphone (e.g., $A_M$), and second audio data (e.g., B) may include the first user utterances as interfering audio signals to the second microphone (e.g., $B_M$).

Further, for example, cancelling coefficients (e.g., $\mu_{BC}$, $\mu_{CB}$) may be determined between the second audio data (e.g., B) received at the second microphone (e.g., $B_M$) and the third audio data (e.g., C) received at the third microphone (e.g., $C_M$), wherein the second audio data (e.g., B) and the third audio data (e.g., C) correspond to the second user speaking (e.g., second user utterances) and the third user speaking (e.g., third user utterances) within proximity of the second microphone (e.g., $B_M$) and the third microphone (e.g., $C_M$), respectively. Furthermore, the second audio data (e.g., B) may include the third utterances as interfering audio signals to the second microphone (e.g., $B_M$), and the third audio data (e.g., C) may include the second utterances as interfering audio signals to the third microphone (e.g., $C_M$).

Even further for example, cancelling coefficients (e.g., $\mu_{AC}$, $\mu_{CA}$) may be determined between the first audio data (e.g., A) received at the first microphone (e.g., $A_M$) and the third audio data (e.g., C) received at the third microphone (e.g., $C_M$), wherein the first audio data (e.g., A) and the third audio data (e.g., C) correspond to the first user speaking (e.g., first user utterances) and the third user speaking (e.g., third user utterances) within proximity of the first microphone (e.g., $A_M$) and the third microphone (e.g., $C_M$), respectively. Furthermore, the first audio data (e.g., A) may include the third user utterances as interfering audio signals to the first microphone (e.g., $A_M$), and the third audio data (e.g., C) may include the first utterances as interfering audio signals to the third microphone (e.g., $C_M$).

In an embodiment, to cancel all user utterances detected at the second microphone (e.g., $B_M$) except for the second user speaking (e.g., second user utterances) within the closest proximity to the second microphone (e.g., $B_M$), then the one or more processors may be configured to generate second output audio data corresponding to the following expression: $B_0=(A_{BM}+B_{BM}+C_{BM})-\mu_1(A_{AM}+B_{AM}+C_{AM})-\mu_2(A_{CM}+B_{CM}+C_{CM})$, wherein a product of the cancelling coefficient for the respective audio inputs of the first microphone and the third microphone is subtracted from the sum of the audio inputs at the second microphone, thereby cancelling the interfering user utterances (e.g., first user utterance and third user utterance) detected at the second microphone. In this example, $A_{BM}$ corresponds to the first user utterance detected at the second microphone, $B_{BM}$ corresponds to the second user utterance detected at the second microphone, $C_{BM}$ corresponds to the third user utterance detected at the second microphone, $A_{AM}$ corresponds to the first user utterance detected at the first microphone, $B_{AM}$ corresponds to the second user utterance detected at the first microphone, $C_{AM}$ corresponds to the third user utterance detected at the first microphone, $A_{CM}$ corresponds to the first user utterance detected at the third microphone, $B_{CM}$ corresponds to the second user utterance detected at the third microphone, and $C_{CM}$ corresponds to the third user utterance detected at the third microphone.

In an embodiment, the one or more processors may be configured to determine the cancelling coefficients (e.g., $\mu 1$, $\mu_2$) based on setting the second output audio data equal to the second user utterance detected at the first microphone, the second microphone and the third microphone to 0 (e.g. $B_o=B_{BM}=B_{AM}=B_{CM}=0$), resulting in the following expression: $0=(A_{BM}+C_{BM})-\mu_1(A_{AM}+C_{AM})-\mu_2(A_{CM}+C_{CM})$. Additionally, if $A_{BM}=\mu_{AB}A_{AM}$, $A_{CM}=\mu_{AC}A_{AM}$, $C_{BM}=\mu_{CB}C_{CM}$, and $C_{AM}=\mu_{CA}C_{CM}$, then the following expressions are provided: $0=(\mu_{AB}A_{AM}+\mu_{CB}C_{CM})-\mu_1(A_{AM}+\mu_{CA}C_{CM})-\mu_2(\mu_{AC}A_{AM}+C_{CM})$ and $0=(\mu_{AB}-\mu_1-\mu_2\mu_{AC})A_{AM}+(\mu_{CB}-\mu_1\mu_{CA}-\mu_2)C_{CM}$, whereby determining the cancelling coefficients (e.g., $\mu_1$, $\mu_2$) is based on satisfying the following expressions: $(\mu_{AB}-\mu_1-\mu_2\mu_{AC})=0$, $(\mu_{CB}-\mu_1\mu_{CA}-\mu_2)=0$. Therefore, the one or more processors may be configured to generate second output audio data corresponding to the following expression: $B_o=B_{BM}-\mu_1B_{AM}-\mu_2B_{CM}=(1-\mu_1\mu_{BA}-\mu_2\mu_{BC})B_{BM}$, wherein the first user utterance and the third user utterances as interfering audio signals are cancelled. Similarly, first output audio data (e.g., $A_o$) may be generated cancelling the second user utterance and third user utterance as interfering audio signals to the second input audio data and third output audio (e.g., $C_o$) data may be generated cancelling the first user utterance and the second user utterance as interfering audio signals to the third input audio data.

In an embodiment, the cancelling coefficients (e.g., $\mu_1$, $\mu_2$) may be expressed by the following: $(\mu_{AB}-\mu 1-\mu_2\mu AC)=0$, $(\mu_{CB}-\mu_1\mu_{CA}-\mu_2)=0$, wherein $$\mu 1 = \frac{\mu AB - \mu AC\mu CB}{1 - \mu CA\mu AC}, \mu 2 = \frac{\mu CB - \mu AB\mu CA}{1 - \mu CA\mu AC}.$$

For example, it is considered that $\mu_{CA}\mu_{AC}$ satisfying $1-\mu_{CA}\mu_{AC}=0$ is provided when the first user (e.g., A) and the third user (e.g., C) are located at the center of the first microphone $A_M$ and second microphone $C_M$, respectively. In other words, when the first user (e.g., A) and the third user (e.g., C) are located in a state where the distance between the first user (e.g., A) and the first microphone $A_M$ is equal to the distance between the first user (e.g., A) and the third microphone $C_M$ because the original cancelling coefficient μ (or sound attenuation) is expressed by a ratio of distance from a sound source.

In an embodiment, on the assumption that the distance between A and $A_M$ is R1 and the distance between the first user (e.g., A) and the second microphone $B_M$ is R2, the volume of sound input to the second microphone $B_M$ is less than the volume of sound input to the first microphone $A_M$ by D[dB] as expressed below: D=20×log 10 (R2/R1). In other words, it is expressed by $$(R2/R1) = 10^{\frac{D}{20}},$$

or deemed to be a multiple of $$1/10^{\frac{D}{20}} = \mu_{AB}.$$

As a theoretical value, μ is a value equivalent to a "ratio of distance." Accordingly, when considering a ratio of distance satisfying $1-\mu_{CA}\mu_{AC}=0$, $\mu_{CA}\mu_{AC}$ is provided when A and C are located with an equivalent ratio of distance to the microphones $A_M$ and $C_M$ respectively.

In an embodiment, the one or more processors may be configured to determine cancelling (or attenuation) coefficients based on detected user utterances for the interfering audio signals. For example, a first cancelling coefficient (e.g., $\mu_{AB}$) for a first user utterance detected at a second microphone (e.g., $A_{BM}$) may be determined based on receiving and processing the first user utterance at the second microphone and a second cancelling coefficient (e.g., $\mu_{AC}$) for the first user utterance detected at a third microphone (e.g., $A_{CM}$) may be determined based on the receiving and processing the first user utterance at the third microphone. In other words, the cancelling coefficients may be calculated at a time in which only the first user is speaking. Similarly, cancelling coefficients (e.g., $\mu_{BA}$, $\mu_{BC}$) for a second user utterance detected at the first microphone and the second user utterance detected at the third microphone may be determined based on receiving and processing the second user utterance at the first microphone and receiving and processing the second user utterance at the third microphone, respectively. Further similarly, cancelling coefficients (e.g., $\mu_{CA}$, $\mu_{CB}$) for a third user utterance detected at the first microphone and the third user utterance detected at the second microphone may be determined based on receiving and processing the third user utterance at the first microphone and receiving and processing the third user utterance at the second microphone, respectively. Therefore, the cancelling coefficients may be determined when only one user utterance (e.g., only one person is speaking) is detected at two or more microphones.

In an embodiment, the one or more processors may be configured to determine whether the cancelling coefficient is required to generate output audio data cancelling interfering audio signals. For example, determination criteria for updating the cancelling coefficient are based at least on an assumption that an initial value of the cancelling coefficient is 0. In some embodiments, a first user is making a first user utterance (e.g., $A_{AM}$) detectable by a first microphone of a first computing device and a second user is making a second user utterance (e.g., $B_{BM}$) detectable by a second microphone of a second computing device, wherein the first user utterance (e.g., $A_{BM}$) may also be detectable by the second microphone and the second user utterance (e.g., $B_{AM}$) may also be detectable by the first microphone as interfering audio signals. Further, a first cancelling coefficient (e.g., $\mu B_A$) for cancelling the second user utterance detectable by the first microphone may be considered in the following expression: $A_o=(A_{AM}+B_{AM})-\mu B_A(A_{BM}+B_{BM})$, wherein a first duration coefficient (e.g., $\mu A_B$) corresponds to a time duration in which the first user is not speaking and can be determined by the following expression: $A_o=A_{AM}=A_{BM}=0$. Thus, if the second user utterance detected by the first microphone does not equal the first cancelling coefficient times the second user utterance detected at the second microphone, (described by the following expression: $B_{AM}\neq\mu_{BA}B_{BM}$) then the first cancelling coefficient (e.g., $\mu_{BA}$) may be determined to require an update.

In other example embodiments of the present invention, multiple user utterances from different users may be detected while the users may be engaged in respective online conferences or meeting in an open space, wherein users participating in the online conferences at other locations may only be allowed to hear the voice of the user attending same online conference because the other interfering user utterances would be cancelled in the output audio data to the computing device of the attending user.

In other example embodiments of the present invention, the one or more processors may be configured to receive a first user utterance from a first microphone of a first user in an automobile or a vehicle, receive other user utterances from other microphones of other users in the automobile, determine a cancelling coefficient to reduce or cancel the audio signals of the other user utterances, and generate output audio comprising only the first user utterance as described above herein. In an embodiment, the automobile may include microphones installed in respective seats in which the first user and the other users occupy.

Implementation of embodiments of the invention may take a variety of forms, and exemplary implementation details are discussed subsequently with reference to the Figures.

FIG. 1 is a functional block diagram illustrating a distributed data processing environment 100 for irrelevant voice cancellation, in accordance with an embodiment of the present invention. The term "distributed" as used herein describes a computer system that includes multiple, physically distinct devices that operate together as a single computer system. FIG. 1 provides only an illustration of one implementation and does not imply any limitations with regard to the environments in which different embodiments may be implemented. Many modifications to the depicted environment may be made by those skilled in the art without departing from the scope of the invention as recited by the claims.

In the depicted embodiment, distributed data processing environment 100 includes a plurality of user devices (e.g., first user device 120-1, second user device 120-2), database 124 and server 125 interconnected via network 110. Distributed data processing environment 100 may include database 124 configured to store data received from, and transmit data to, components (e.g., first user device 120-1, second user device 120-2) within distributed data processing environment 100 for irrelevant voice cancellation. Distributed data processing environment 100 may also include additional servers, computers, sensors, or other devices not shown. Each component (e.g., first user device 120-1, second user device 120-2) may be configured to communicate data among each other independent of network 110.

Network 110 operates as a computing network that can be, for example, a local area network (LAN), a wide area network (WAN), or a combination of the two, and can include wired, wireless, or fiber optic connections. In general, network 110 can be any combination of connections and protocols that will support communications between first user device 120-1 and second user device 120-2.

The plurality of user devices (e.g., first user device 120-1, second user device 120-2) operate as personal computing devices. User device 120 may be configured to send and/or receive data from network 110 or via other system components within distributed data processing environment 100. In some embodiments, user device 120 may be a laptop computer, tablet computer, netbook computer, personal computer (PC), a desktop computer, a smart phone, smart speaker, virtual assistant, voice command device or any programmable electronic device capable of receiving or detecting audible inputs, processing the audible inputs, and audibly outputting an associated response. User device 120 may include components as described in further detail in FIG. 7.

Database 124 may be configured to operate as a repository for data flowing to and from network 110 and other connected components. Examples of data include user data, device data, network data, audio data, input audio data, output audio data, and data corresponding to user utterances, user utterance decibel measures, cancelling coefficients. A database is an organized collection of data. Database 124 can be implemented with any type of storage device capable of storing data and configuration files that can be accessed and utilized by server 125 and/or user device 120, such as a database server, a hard disk drive, or a flash memory. In an embodiment, database 124 may be accessed by the plurality of user devices (e.g., first user device 120-1 and second user device 120-2), via network 110 or independent of network 110, to store and receive data corresponding to irrelevant voice cancellation program 132 executing on any user device 120. In another embodiment, database 124 may be accessed by server 125 to access user data, device data, network data or other data associated with irrelevant voice cancellation program 132. Database 124 may also be accessed by the plurality of user devices to store data corresponding to audio data corresponding to user utterances and other ambient or background noise processed and generated by user device 120. In another embodiment, database 124 may reside elsewhere within distributed network environment 100 provided database 124 have access to network 110.

Audio data may include data compatible with JavaScript® Object Notation ("JSON") data-interchange format and voice commands data. Java and all Java-based trademarks and logos are trademarks or registered trademarks of Oracle and/or its affiliates. Audio data may also include data corresponding to text-to-voice conversations between a user and another party. For example, audio data may include audible user utterances as voice sounds spoken by a user. The user utterances may include conversational utterances exchanged during an online conference. The user utterances may also include decibel measures corresponding to an amplitude of the audio waves of the user voice. Furthermore, audio data may be provided to database 124 via an external source or received from one or more of the components in communication with database 124.

Server 125 can be a standalone computing device, a management server, a web server, or any other electronic device or computing system capable of receiving, sending, and processing data and capable of communicating with user device 120 via network 110. In other embodiments, server 125 represents a server computing system utilizing multiple computers as a server system, such as a cloud computing environment. In yet other embodiments, server 125 represents a computing system utilizing clustered computers and components (e.g., database server computers, application server computers, etc.) that act as a single pool of seamless resources when accessed within distributed data processing environment 100. Server 125 may include components as described in further detail in FIG. 7.

The user utterance may include voice characteristics based on user characteristics that uniquely distinguish one user's voice from another user's voice. For instance, the voice characteristics may include pitch, speech rate, tone, texture, intonation, loudness, etc., wherein the combination of one or more of the voice characteristics may result in a unique voice corresponding to an accent or a dialect.

Figure 2:
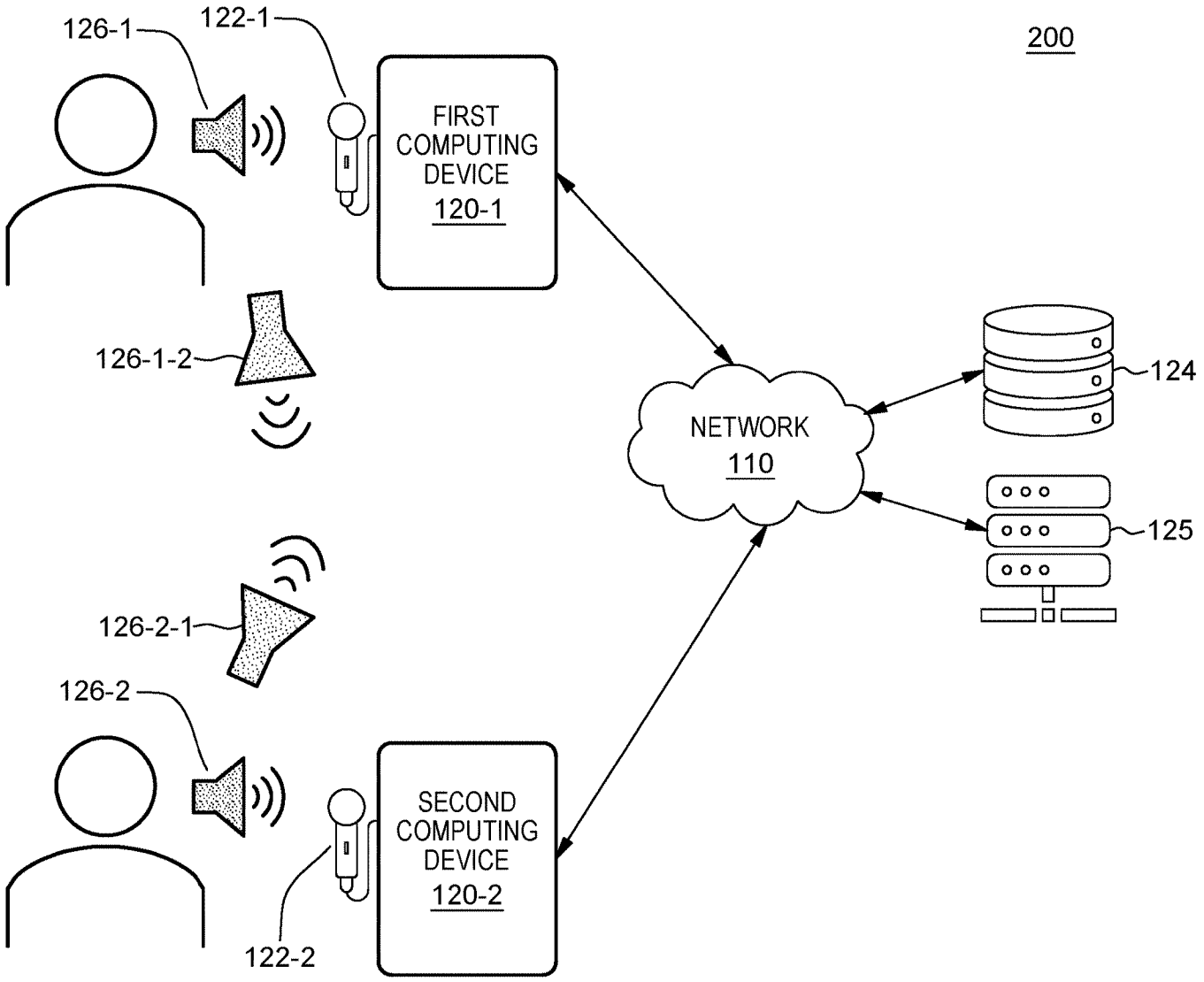
FIG. 2 is a functional block diagram illustrating an acoustic model distributed data processing environment for irrelevant voice cancellation, in accordance with an embodiment of the present invention.

FIG. 2 is a functional block diagram illustrating an acoustic model distributed data processing environment 200 for irrelevant voice cancellation, in accordance with an embodiment of the present invention.

In an embodiment, acoustic environment 200 may include the components described in FIG. 1, with the addition of illustrations of acoustic sound waves uttered by users of respective computing devices (e.g., first computing device 120-1, second computing device 120-2).

In an embodiment, acoustic environment 200 may include first computing device 120-1 comprising first microphone 122-1 configured to receive first audio data including at least first (local) user utterance 126-1 coming from a first user associated with first computing device 120-1. Further, in an embodiment, first audio data may also include second user (remote) utterance 126-2-1 coming from a second user associated with second computing device 120-2. In other words, first audio data may include any audio data received by first microphone 122-1. Furthermore, first user (local) utterance 126-1 may include a first user utterance local decibel measure (measured at first microphone 122-1) that is greater than a second user utterance remote decibel measure (measured at first microphone 122-1) of second user (remote) utterance 126-2-1 due to the distance between the first user and the second user relative to first microphone 122-1.

In an embodiment, acoustic environment 200 may include second computing device 120-2 comprising second microphone 122-2 configured to receive second audio data including at least second user (local) utterance 126-2 coming from a second user associated with second computing device 120-2. Further, in an embodiment, second audio data may also include first user (remote) utterance 126-1-2 coming from the first user associated with first computing device 120-1. In other words, second audio data may include any audio data received by second microphone 122-2. Furthermore, second user (local) utterance 126-2 may include a second user utterance local decibel measure (measured at second microphone 122-2) that is greater than a first user utterance remote decibel measure (measured at second microphone 122-2) of first user (remote) utterance 126-1-2 due to the distance between the second user and the first user relative to second microphone 122-2.

Figure 3:
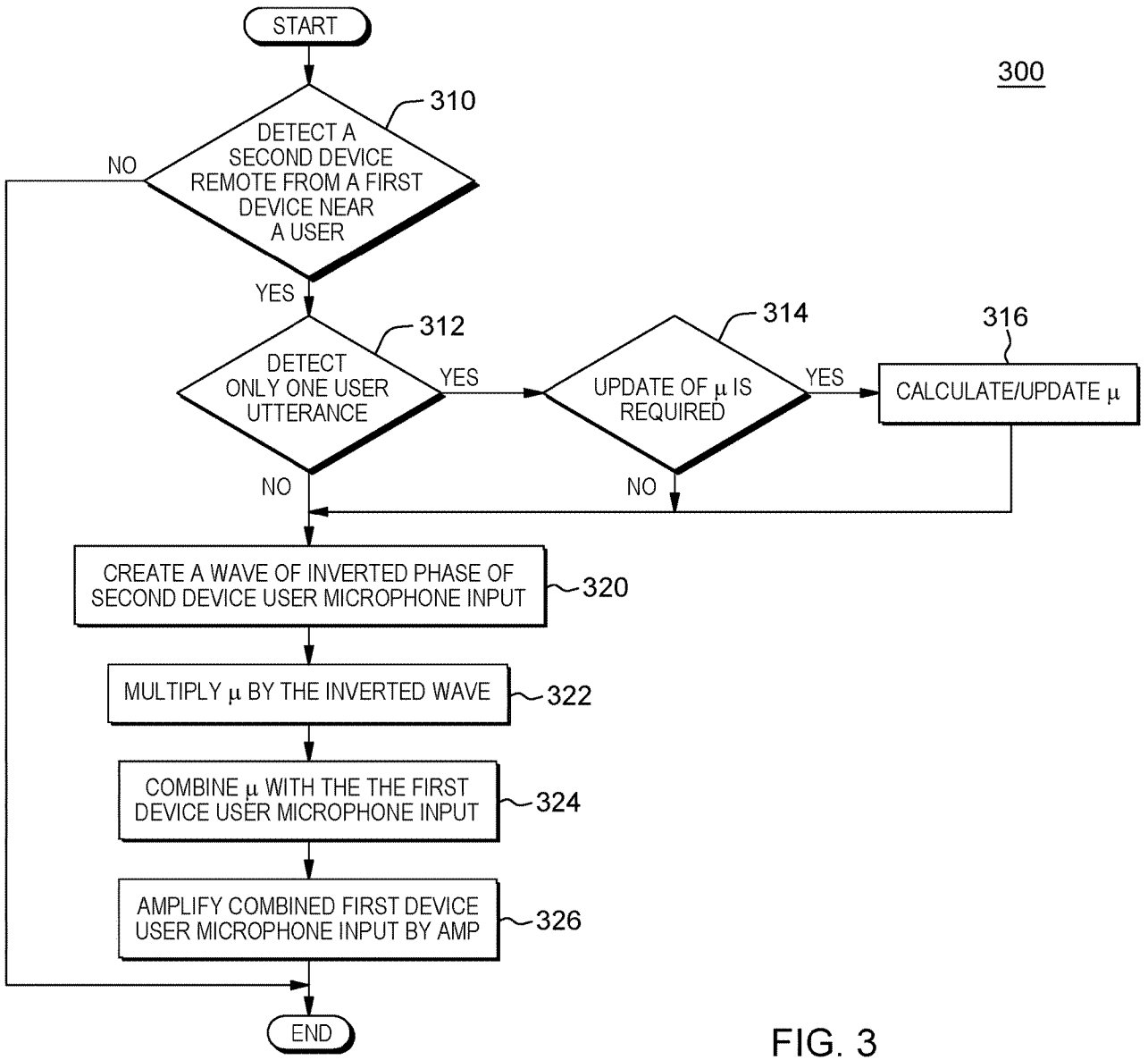
FIG. 3 is a flowchart depicting operational steps of a computer-implemented method for irrelevant voice cancellation, in accordance with an embodiment of the present invention.

FIG. 3 is a flowchart depicting operational steps of a computer-implemented method 300 for irrelevant voice cancellation, in accordance with an embodiment of the present invention.

In an embodiment, method 300 may include one or more processors configured to detect 310 a second computing device remote from a first computing device near a user. If the second (computing) device is detected, then the one or more processors may be configured to detect 312 only one user utterance has been received at a microphone associated with either one of the first computing device or the second computing device. If only one user utterance is detected, then the one or more processors may be configured to determine 314 if an update of the cancelling coefficient (e.g., μ) is required. Further, if an update of the cancelling coefficient is required, then the one or more processors may be configured to calculate/update 316 the cancelling coefficient. If an update of the cancelling coefficient is not required, then the one or more processors may be configured to create 320 a wave of inverted phase (or wave) of the second (computing) device user microphone input (e.g., second user local utterance).

Further in an embodiment, method 300 may include one or more processors configured to multiply 322 the cancelling coefficient by the inverted wave and combine 324 the cancelling coefficient with the first (computing) device microphone input (e.g., first user local utterance). Further, the one or more processors may be configured to amplify 326 the combined first (computing) device user microphone input (e.g., first user local utterance) by an amplifier (e.g., AMP). For example, the one or more processors may be configured to multiply 322 the cancelling coefficient with the first computing device microphone input may further include creating the cancelling wave or audio signal for cancelling the second user utterance, wherein the cancelling wave may correspond to the following expression: $\mu_{BA}(A_{BM}+B_{BM})$ of $A_0=(A_{AM}+B_{AM})-\mu_{BA}(A_{BM}+B_{BM})$, described above herein. Thus, the one or more processors configured to combine 324 the cancelling wave with first device microphone input (e.g., $A_{AM}+B_{AM}$). Further, the one or more processors configured to amplify 326 may correspond to the coming wave being only related to first user utterance. In other words, $A_0=A_{AM}-\mu_{BA}A_{BM}$, which corresponds to $A_{BM}=\mu_{AB}A_{AM}$. Therefore, $A_0=A_{AM}-\mu_{BA}\mu_{AB}A_{AM}=(1-\mu_{BA}\mu_{AB})A_{AM}$, wherein the one or more processors configured to amplify 326 may correspond to multiplying the following expression: $(1-\mu_{BA}\mu_{AB})$, by the cancelling wave by AMP.

Figure 4:
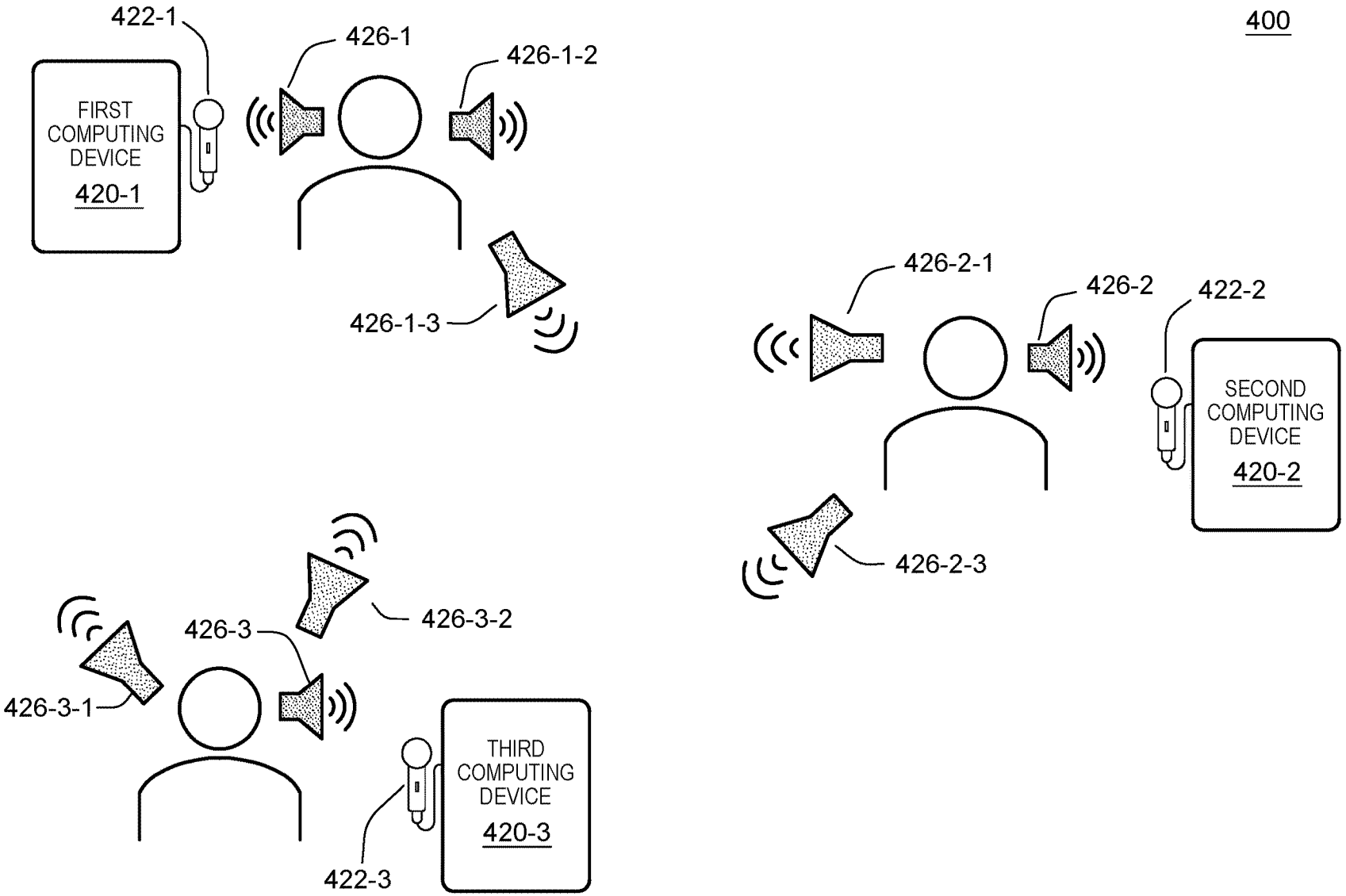
FIG. 4 depicts a system illustrating a distributed data processing environment for irrelevant voice cancellation, in accordance with an embodiment of the present invention.

FIG. 4 depicts a system 400 illustrating a distributed data processing environment for irrelevant voice cancellation, in accordance with an embodiment of the present invention.

In an embodiment, system 400 may include first computing device 420-1 comprising first microphone 422-1 configured to receive first audio data including first user utterance 426-1 from a first user associated with first computing device 420-1. Further, first audio data may further include second user utterance 426-2-1 from a second user associated with second computing device 420-2. Even further, first audio data may include third user utterance 426-3-1 from a third user associated with a computing device.

In an embodiment, system 400 may include second computing device 420-2 comprising second microphone 422-2 configured to receive second audio data including second user utterance 426-2 from a second user associated with second computing device 420-2. Further, second audio data may further include first user utterance 426-1-2 from the first user associated with first computing device 420-1. Even further, second audio data may include third user utterance 426-3-2 from a second user associated with a computing device. To get only second user utterance (in other words, cancelling first and third user utterance), all kinds of μx is required because second user audio output means $Bo=B_{BM}-\mu B_{AM}-\mu_2 B_{CM}=(1-\mu_1\mu_{BA}-\mu_2\mu_{BC})B_{BM}$. More clearly, the third device may be necessary to calculate the cancelling coefficients corresponding to μxC and μCx. Also $\mu_1$ and $\mu_2$ may be calculated as $$\mu 1 = \frac{\mu AB - \mu AC\mu CB}{1 - \mu CA\mu AC}, \mu 2 = \frac{\mu CB - \mu AB\mu CA}{1 - \mu CA\mu AC}$$

as described above herein. In addition, the cancelling coefficient μ for three or more people (such as μ1, μ2) can be calculated by the coefficient μ for 2 people (such as $\mu_{AB}$, $\mu_{AC}$, $\mu_{BC}$, . . . ). If two or more people are speaking when calculating μ1, μ2, then the resources necessary to perform such calculations would significantly increase.

Figure 5:
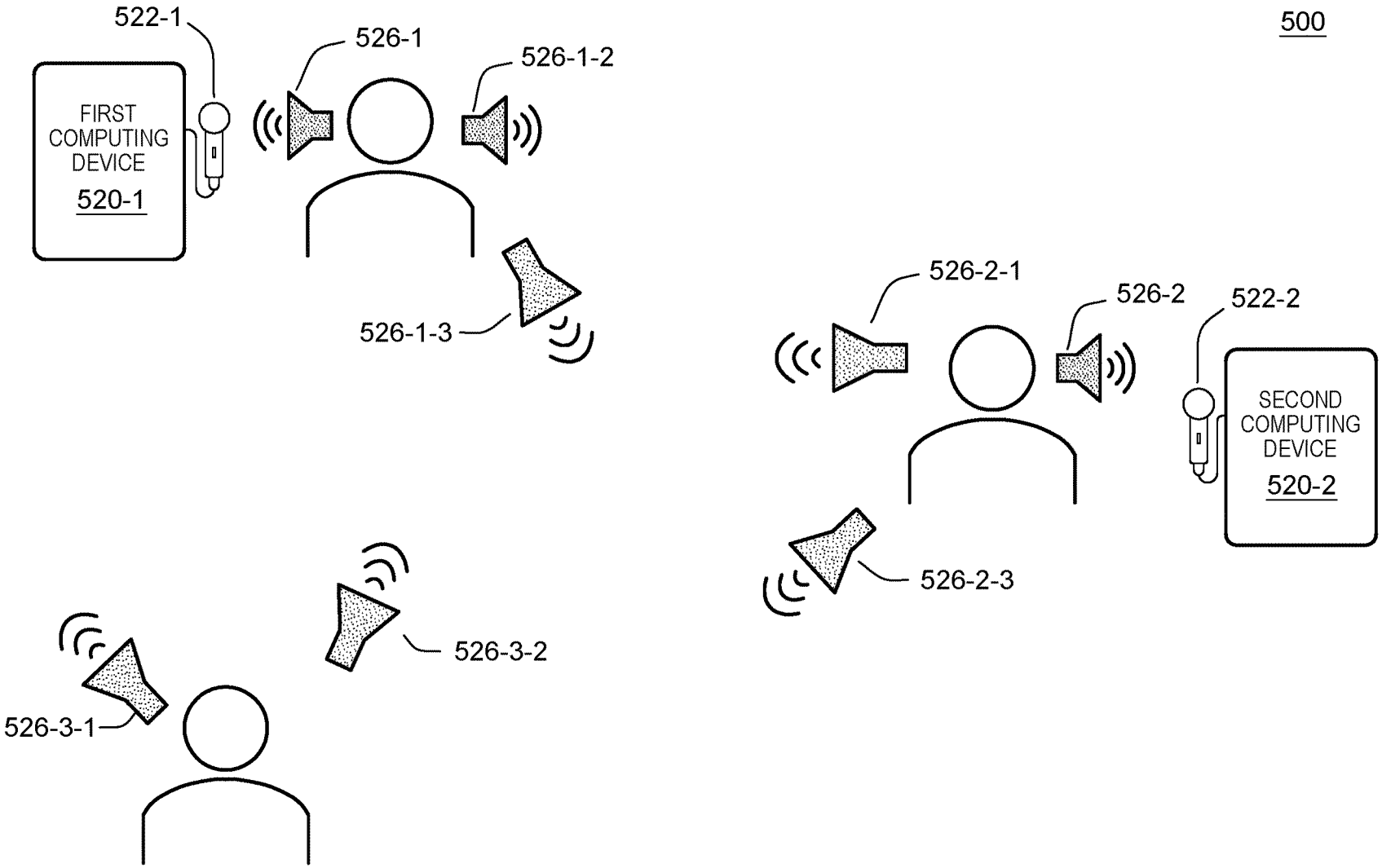
FIG. 5 depicts a system illustrating a modified distributed data processing environment for irrelevant voice cancellation, in accordance with an embodiment of the present invention.

FIG. 5 depicts a system 500 illustrating a modified distributed data processing environment for irrelevant voice cancellation, in accordance with an embodiment of the present invention.

In an embodiment, system 500 may be similar to system 400, except that the third user may not be associated with a computing device (e.g., FIG. 4's third computing device 422-3 not included), however, first microphone 522-1 may still be configured to receive third user utterance 526-3-1 from the third user and second microphone 526-2 may still be configured to receive third user utterance 526-3-2 from the third user.

In an embodiment, system 500 may include one or more processors configured to determine cancelling coefficients (e.g., $\mu_{AB}$, $\mu_{BA}$, $\mu_{AC}$, $\mu_{CA}$, $\mu_{BC}$, $\mu_{CB}$) between the first user, the second user, and the second user, respectively. For example, the one or more processors may be configured to generate first output audio data (e.g., $A_o=(A_{AM}+B_{AM}+C_{AM})-\mu_{BA}(A_{BM}+B_{BM}\ C_{BM})=(A_{AM}-\mu_{BA}A_{BM})+(C_{AM}-\mu_{BA}C_{BM}))$ corresponding to first user utterance 526-1 received at first microphone 522-1 with interfering audio signals (e.g., second user utterance 526-2-1 coming from the second user and third user utterance 526-3-1 coming from the third user) cancelled so that the third user utterance 526-1 is mixed in the first output audio data by the following expression: $C_{AM}-\mu_{BA}C_{BM}$. Similarly, second output audio data (e.g., $B_o$) may be determined. In this example, third user utterance 526-3 is not limited to a speaker and may be replaced with any kinds of noise. In other words, the speech voice of the third user may be equivalent to noise detected at either of the first microphone 522-1 or the second microphone 522-2.

In an embodiment, system 500 (and 400) may include one or more processors configured to determine a nearby device, in accordance with the invention described herein. For example, the one or more processors may include short-wave wireless technology (e.g., Bluetooth®, Infrared, NFC) configured to detect a computing device that is nearby or within a certain proximity to a user computing device, wherein the user computing device may utilize the short-wave wireless technology to determine that another computing device is within the range of proximity. Further, the one or more processors may include global-positioning system (GPS) technology configured to detect a computing device that is nearby or within a certain proximity to a user computing device, wherein the user computing device may utilize the GPS technology to determine that another computing device is within the range of proximity. In the case of GPS, the one or more processors may be configured to determine the proximity of the nearby device based on positional information, wherein a difference of elevation among devices may or may not be taken into consideration.

Figure 6:
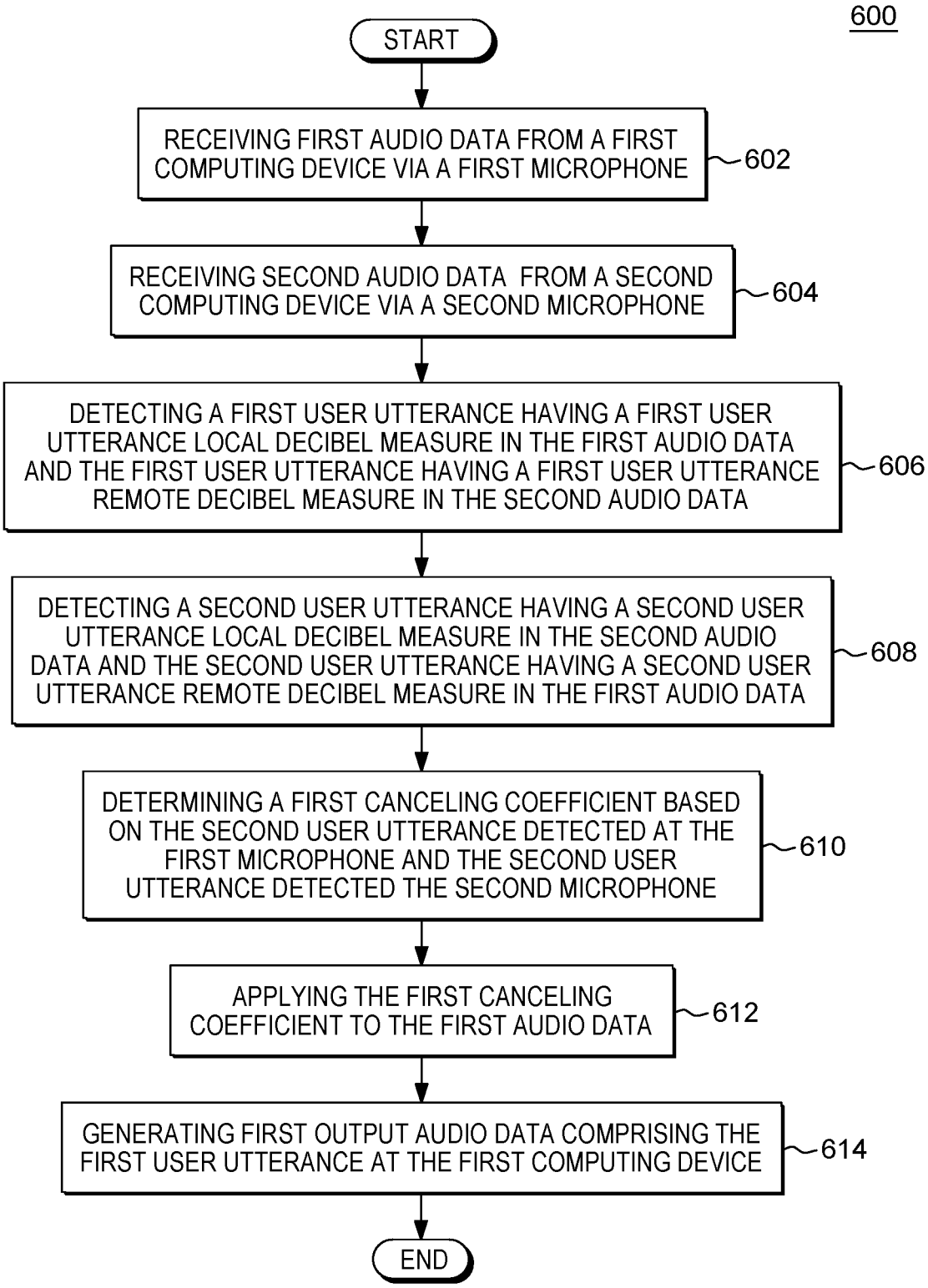
FIG. 6 is a flowchart depicting operational steps of a computer-implemented method for irrelevant voice cancellation, on a server computer within the distributed data processing environment of FIG. 1, in accordance with an embodiment of the present invention.

FIG. 6 is a flowchart depicting operational steps of a computer-implemented method 600 for irrelevant voice cancellation, on a server computer within the distributed data processing environment of FIG. 1, in accordance with an embodiment of the present invention.

In an embodiment, method 600 may include one or more processors configured for receiving 602 first audio data at a first microphone of a first computing device.

In an embodiment, method 600 may include one or more processors configured for receiving 604 second audio data at a second microphone of a second computing device.

In an embodiment, method 600 may include one or more processors configured for detecting 606 a first user utterance having a first user utterance local decibel measure in the first audio data and the first user utterance having a first user utterance remote decibel measure in the second audio data.

In an embodiment, method 600 may include one or more processors configured for detecting 608 a second user utterance having a second user utterance local decibel measure in the second audio data and the second user utterance having a second user utterance remote decibel measure in the first audio data.

In an embodiment, method 600 may include one or more processors configured for determining 610 a first cancelling coefficient based on the second user utterance detected at the first microphone and the second user utterance detected the second microphone.

In an embodiment, method 600 may include one or more processors configured for generating a second user utterance cancelling value as a quotient of the second user utterance detected at the first microphone and the second user utterance detected at the second microphone.

In an embodiment, method 600 may include one or more processors configured for applying 612 applying the first cancelling coefficient to the first audio data.

In an embodiment, applying 612 the first cancelling coefficient may further include one or more processors configured for applying the first cancelling coefficient to the second user utterance in the first audio data.

In an embodiment, method 600 may include one or more processors configured for generating 614 first output audio data comprising the first user utterance at the first computing device.

In an embodiment, method 600 may include one or more processors configured for determining a second cancelling coefficient based on the first user utterance detected at the second microphone and the first user utterance detected at the first microphone.

In an embodiment, method 600 may include one or more processors configured for applying the second cancelling coefficient to the second audio data.

In an embodiment, method 600 may include one or more processors configured for generating second output audio data comprising the second user utterance at the second computing device.

In an embodiment, the first user utterance local decibel measure may be greater than the second user utterance remote decibel measure.

In an embodiment, the second user utterance local decibel measure may be greater than the second user utterance local decibel measure.

In an embodiment, the first output audio data may correspond to a difference between the first audio data (e.g., user utterances detected at the first computing device) and the first cancelling coefficient applied to the interfering user utterances (e.g., the second user utterance remotely detected) in the first audio data.

Figure 7:
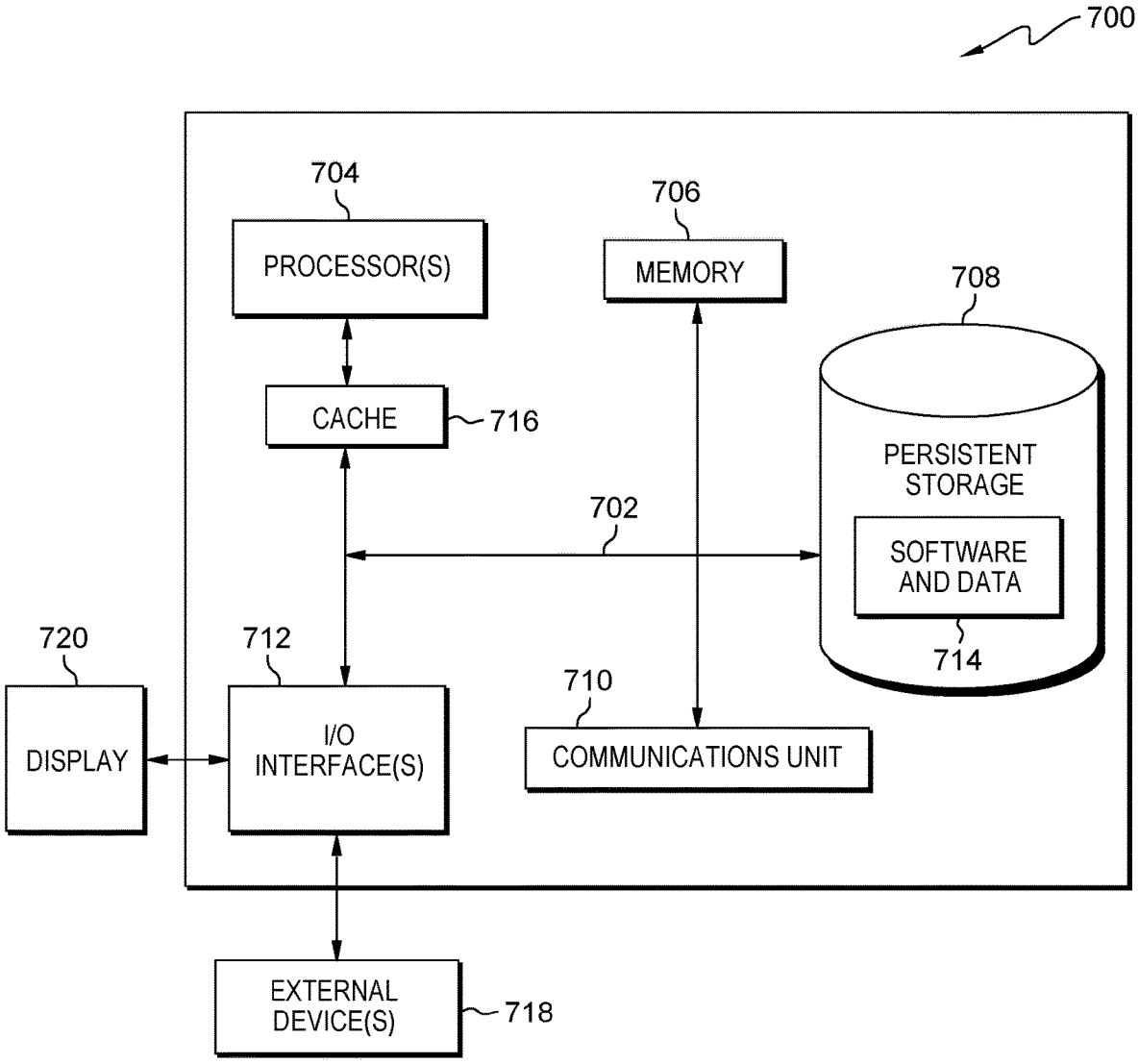
FIG. 7 depicts a block diagram of components of the server computer executing computer-implemented method for irrelevant voice cancellation within the distributed data processing environment of FIG. 1, in accordance with an embodiment of the present invention.

FIG. 7 depicts a block diagram of components of the server computer executing computer-implemented method for irrelevant voice cancellation within the distributed data processing environment of FIG. 1, in accordance with an embodiment of the present invention. It should be appreciated that FIG. 7 provides only an illustration of one implementation and does not imply any limitations with regard to the environments in which different embodiments can be implemented. Many modifications to the depicted environment can be made.

FIG. 7 depicts a block diagram of computer 700 suitable for user device 120 or computing devices, in accordance with an illustrative embodiment of the present invention. It should be appreciated that FIG. 7 provides only an illustration of one implementation and does not imply any limitations with regard to the environments in which different embodiments may be implemented. Many modifications to the depicted environment may be made.

Computer 700 includes communications fabric 702, which provides communications between cache 716, memory 706, persistent storage 708, communications unit 710, and input/output (I/O) interface(s) 712. Communications fabric 702 can be implemented with any architecture designed for passing data and/or control information between processors (such as microprocessors, communications and network processors, etc.), system memory, peripheral devices, and any other hardware components within a system. For example, communications fabric 702 can be implemented with one or more buses or a crossbar switch.

Memory 706 and persistent storage 708 are computer readable storage media. In this embodiment, memory 706 includes random access memory (RAM). In general, memory 706 can include any suitable volatile or non-volatile computer readable storage media. Cache 716 is a fast memory that enhances the performance of computer processor(s) 704 by holding recently accessed data, and data near accessed data, from memory 706.

Software and data 714 may be stored in persistent storage 708 and in memory 706 for execution and/or access by one or more of the respective computer processors 704 via cache 716. In an embodiment, persistent storage 708 includes a magnetic hard disk drive. Alternatively, or in addition to a magnetic hard disk drive, persistent storage 708 can include a solid state hard drive, a semiconductor storage device, read-only memory (ROM), erasable programmable read-only memory (EPROM), flash memory, or any other computer readable storage media that is capable of storing program instructions or digital information.

The media used by persistent storage 708 may also be removable. For example, a removable hard drive may be used for persistent storage 708. Other examples include optical and magnetic disks, thumb drives, and smart cards that are inserted into a drive for transfer onto another computer readable storage medium that is also part of persistent storage 708.

Communications unit 710, in these examples, provides for communications with other data processing systems or devices. In these examples, communications unit 710 includes one or more network interface cards. Communications unit 710 may provide communications through the use of either or both physical and wireless communications links. Software and data 714 may be downloaded to persistent storage 708 through communications unit 710.

I/O interface(s) 712 allows for input and output of data with other devices that may be connected to user device 120. For example, I/O interface 712 may provide a connection to external devices 718 such as a keyboard, keypad, a touch screen, and/or some other suitable input device. External devices 718 can also include portable computer readable storage media such as, for example, thumb drives, portable optical or magnetic disks, and memory cards. Software and data 714 used to practice embodiments of the present invention can be stored on such portable computer readable storage media and can be loaded onto persistent storage 708 via I/O interface(s) 712. I/O interface(s) 712 also connect to a display 720.

Display 720 provides a mechanism to display data to a user and may be, for example, a computer monitor.

The present invention may contain various accessible data sources, such as database 124, that may include personal data, content, or information the user wishes not to be processed. Personal data includes personally identifying information or sensitive personal information as well as user information, such as tracking or geolocation information. Processing refers to any, automated or unautomated, operation or set of operations such as collection, recording, organization, structuring, storage, adaptation, alteration, retrieval, consultation, use, disclosure by transmission, dissemination, or otherwise making available, combination, restriction, erasure, or destruction performed on personal data. Software and data 714 may enable the authorized and secure processing of personal data. Software and data 714 may be configured to provide informed consent, with notice of the collection of personal data, allowing the user to opt in or opt out of processing personal data. Consent can take several forms. Opt-in consent can impose on the user to take an affirmative action before personal data is processed. Alternatively, opt-out consent can impose on the user to take an affirmative action to prevent the processing of personal data before personal data is processed. Software and data 714 may provide information regarding personal data and the nature (e.g., type, scope, purpose, duration, etc.) of the processing. Software and data 714 provide the user with copies of stored personal data. Software and data 714 allow the correction or completion of incorrect or incomplete personal data. Software and data 714 allow the immediate deletion of personal data.

The computer-implemented methods described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The present invention may be a system, a computer-implemented method, and/or a computer program product. The computer program product may include a computer readable storage medium (or media) having computer readable program instructions thereon for causing a processor to carry out aspects of the present invention.

The computer readable storage medium can be any tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, a special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus, or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, a segment, or a portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

What is claimed is:

1. A computer-implemented method, comprising:

receiving first audio data from a first computing device via a first microphone;

receiving second audio data from a second computing device via a second microphone;

detecting a first user utterance having a first user utterance local decibel measure in the first audio data and the first user utterance having a first user utterance remote decibel measure in the second audio data;

detecting a second user utterance having a second user utterance local decibel measure in the second audio data and the second user utterance having a second user utterance remote decibel measure in the first audio data;

determining a first cancelling coefficient based on the second user utterance detected at the first microphone and the second user utterance detected at the second microphone;

applying the first cancelling coefficient to the first audio data; and generating first output audio data comprising the first user utterance at the first computing device.

2. The computer-implemented method of claim 1, further comprising:

determining a second cancelling coefficient based on the first user utterance detected at the second microphone and the first user utterance detected at the first microphone;

applying the second cancelling coefficient to the second audio data; and generating by the one or more processors, second output audio data comprising the second user utterance at the second computing device.

3. The computer-implemented method of claim 1, wherein the first user utterance local decibel measure is greater than the second user utterance remote decibel measure.

4. The computer-implemented method of claim 1, wherein the second user utterance local decibel measure is greater than the second user utterance remote decibel measure.

5. The computer-implemented method of claim 1, wherein the determining the first cancelling coefficient further comprises:

generating a second user utterance cancelling value as a quotient of the second user utterance detected at the first microphone and the second user utterance detected the second microphone.

6. The computer-implemented method of claim 1, wherein applying the first cancelling coefficient to the first audio data further comprises:

applying the first cancelling coefficient to the second user utterance in the first audio data.

7. The computer-implemented method of claim 1, wherein the first output audio data corresponds to a difference between the first user utterance at the first computing device and the first cancelling coefficient applied to the second user utterance in the first audio data.

8. A computer program product, the computer program product comprising:

one or more computer readable storage media and program instructions collectively stored on the one or more computer readable storage media, the stored program instructions comprising:

program instructions to receive first audio data from a first computing device via a first microphone;

program instructions to receive second audio data from a second computing device via a second microphone;

program instructions to detect a first user utterance having a first user utterance local decibel measure in the first audio data and the first user utterance having a first user utterance remote decibel measure in the second audio data;

program instructions to detect a second user utterance having a second user utterance local decibel measure in the second audio data and the second user utterance having a second user utterance remote decibel measure in the first audio data;

program instructions to determine a first cancelling coefficient based on the second user utterance detected at the first microphone and the second user utterance detected at the second microphone;

program instructions to apply the first cancelling coefficient to the first audio data; and program instructions to generate first output audio data comprising the first user utterance at the first computing device.

9. The computer program product of claim 8, further comprising:

program instructions to determine a second cancelling coefficient based on the first user utterance detected at the second microphone and the first user utterance detected at the first microphone;

program instructions to apply the second cancelling coefficient to the second audio data; and program instructions to generate second output audio data comprising the second user utterance at the second computing device.

10. The computer program product of claim 8, wherein the first user utterance local decibel measure is greater than the second user utterance remote decibel measure.

11. The computer program product of claim 8, wherein the second user utterance local decibel measure is greater than the second user utterance remote decibel measure.

12. The computer program product of claim 8, wherein the program instructions to determine the first cancelling coefficient further comprises:

program instructions to generate a second user utterance cancelling value as a quotient of the second user utterance detected at the first microphone and the second user utterance detected the second microphone.

13. The computer program product of claim 8, wherein the program instructions to apply the first cancelling coefficient to the first audio data further comprises:

program instructions to apply the first cancelling coefficient to the second user utterance in the first audio data.

14. The computer program product of claim 8, wherein the first output audio data corresponds to a difference between the first user utterance at the first computing device and the first cancelling coefficient applied to the second user utterance in the first audio data.

15. A computer system, the computer system comprising:

one or more computer processors;

one or more computer readable storage media;

program instructions collectively stored on the one or more computer readable storage media for execution by at least one of the one or more computer processors, the stored program instructions comprising:

program instructions to receive first audio data from a first computing device via a first microphone;

program instructions to receive second audio data from a second computing device via a second microphone;

program instructions to detect a first user utterance having a first user utterance local decibel measure in the first audio data and the first user utterance having a first user utterance remote decibel measure in the second audio data;

program instructions to detect a second user utterance having a second user utterance local decibel measure in the second audio data and the second user utterance having a second user utterance remote decibel measure in the first audio data;

program instructions to determine a first cancelling coefficient based on the second user utterance detected at the first microphone and the second user utterance detected at the second microphone;

program instructions to apply the first cancelling coefficient to the first audio data; and program instructions to generate first output audio data comprising the first user utterance at the first computing device.

16. The computer system of claim 15, further comprising:

program instructions to determine a second cancelling coefficient based on the first user utterance detected at the second microphone and the first user utterance detected at the first microphone;

program instructions to apply the second cancelling coefficient to the second audio data; and program instructions to generate second output audio data comprising the second user utterance at the second computing device.

17. The computer system of claim 15, wherein the first user utterance local decibel measure is greater than the second user utterance remote decibel measure, and wherein the second user utterance local decibel measure is greater than the second user utterance remote decibel measure.

18. The computer system of claim 15, wherein the program instructions to determine the first cancelling coefficient further comprises:

program instructions to generate a second user utterance cancelling value as a quotient of the second user utterance detected at the first microphone and the second user utterance detected the second microphone.

19. The computer system of claim 15, wherein the program instructions to apply the first cancelling coefficient to the first audio data further comprises:

program instructions to apply the first cancelling coefficient to the second user utterance in the first audio data.

20. The computer system of claim 15, wherein the first output audio data corresponds to a difference between the first user utterance at the first computing device and the first cancelling coefficient applied to the second user utterance in the first audio data.

* * * * *